US009587888B2

(12) United States Patent
Wolfe, IV et al.

(10) Patent No.: US 9,587,888 B2
(45) Date of Patent: Mar. 7, 2017

(54) INTERNAL HEAT EXCHANGER ASSEMBLY

(75) Inventors: Edward Wolfe, IV, E. Amherst, NY (US); Prasad Shripad Kadle, Williamsville, NY (US); Carrie M. Kowsky, Lockport, NY (US); James Alan Bright, Gasport, NY (US)

(73) Assignee: MAHLE International GmbH, Stuttgart (DE)

( * ) Notice: Subject to any disclaimer, the term of this patent is extended or adjusted under 35 U.S.C. 154(b) by 2138 days.

(21) Appl. No.: 12/487,709

(22) Filed: Jun. 19, 2009

(65) Prior Publication Data

US 2010/0018246 A1 Jan. 28, 2010

Related U.S. Application Data

(60) Provisional application No. 61/135,825, filed on Jul. 24, 2008.

(51) Int. Cl.

| | |
|---|---|
| ***F28F 7/02*** | (2006.01) |
| ***F28D 7/02*** | (2006.01) |
| ***F28D 7/10*** | (2006.01) |
| ***F28F 9/013*** | (2006.01) |
| ***F25B 40/00*** | (2006.01) |
| ***F28F 13/06*** | (2006.01) |

(52) U.S. Cl.

CPC ..... *F28D 7/024* (2013.01); *F25B 40/00* (2013.01); *F28D 7/022* (2013.01); *F28D 7/106* (2013.01); *F28F 9/0132* (2013.01); *F28F 13/06* (2013.01); *F25B 2500/01* (2013.01)

(58) Field of Classification Search

CPC ..... F28D 7/024; F28D 7/022; F28D 7/106; F28F 13/06; F28F 9/0132; F28F 1/06; F28F 2210/06; F25B 40/00; F25B 2500/01

USPC ..... 165/156

See application file for complete search history.

(56) References Cited

U.S. PATENT DOCUMENTS

| | | | | | |
|---|---|---|---|---|---|
| 2,775,683 | A | * | 12/1956 | Kleist | 392/398 |
| 3,875,759 | A | * | 4/1975 | Malcosky et al. | 62/394 |
| 4,009,751 | A | * | 3/1977 | Zelnik | 165/156 |
| 4,286,140 | A | * | 8/1981 | Dewulf et al. | 392/493 |
| 4,317,268 | A | * | 3/1982 | Bowden et al. | 29/890.033 |
| 4,696,168 | A | | 9/1987 | Woods et al. | |
| 4,719,969 | A | * | 1/1988 | Patton et al. | 165/160 |
| 4,798,241 | A | * | 1/1989 | Jarrett et al. | 165/109.1 |
| 4,823,865 | A | * | 4/1989 | Hughes | 165/109.1 |
| 5,379,832 | A | | 1/1995 | Dempsey | |

(Continued)

FOREIGN PATENT DOCUMENTS

| | | |
|---|---|---|
| WO | 02/25179 | 3/2002 |

*Primary Examiner* — Jianying Atkisson
*Assistant Examiner* — Jon T Schermerhorn
(74) *Attorney, Agent, or Firm* — Brinks Gilson & Lione

(57) ABSTRACT

An internal heat exchanger assembly for an air conditioning system, having a housing defining a cylindrical with opposing ends. The ends are sealed with end caps having inlets/outlets. A helical coil tube is coaxially disposed within the cylindrical cavity, in which the helical coil includes two tube ends extending in opposing directions and exiting the cylindrical cavity through tube ports provided in the end caps. A twisted elongated strip is coaxially disposed within the cylindrical cavity extending from the first end to the second end. The twisted elongated strip includes a plurality of radially extending fingers adapted to engage the helical coil to maintain the helical coil in a predetermined position.

3 Claims, 6 Drawing Sheets

(56) References Cited

U.S. PATENT DOCUMENTS

| | | | | |
|---|---|---|---|---|
| 5,497,824 | A * | 3/1996 | Rouf | 165/184 |
| 6,076,597 | A | 6/2000 | Manning et al. | |
| 6,463,757 | B1 | 10/2002 | Dickson et al. | |
| 6,715,285 | B2 * | 4/2004 | Isaac, Jr. | 60/520 |
| 7,597,136 | B2 * | 10/2009 | Kite et al. | 165/156 |
| 8,162,040 | B2 * | 4/2012 | Briselden | 165/142 |
| 8,302,673 | B2 * | 11/2012 | Taras et al. | 165/174 |
| 2002/0179292 | A1 | 12/2002 | Zhu et al. | |
| 2006/0124285 | A1 * | 6/2006 | Kite et al. | 165/163 |
| 2007/0224565 | A1 * | 9/2007 | Briselden | 431/207 |
| 2007/0289723 | A1 | 12/2007 | Koster et al. | |
| 2008/0163644 | A1 | 7/2008 | Kadle et al. | |
| 2008/0209933 | A1 * | 9/2008 | Kidwell et al. | 62/260 |

* cited by examiner

INTERNAL HEAT EXCHANGER ASSEMBLY

CROSS REFERENCE TO RELATED APPLICATION

This application claims the benefit of U.S. Provisional Patent Application Ser. No. 61/135,825 for a OPTIMUM SPIRAL TYPE HEAT EXCHANGER, filed on Jul. 24, 2008, which is hereby incorporated by reference in its entirety. This claim is made under 35 U.S.C. §119(e); 37 C.F.R. §1.78; and 65 Fed. Reg. 50093.

TECHNICAL FIELD OF INVENTION

The invention relates to an internal heat exchanger assembly for an automotive air conditioning system; more particularly, to an internal heat exchanger assembly having an internal helical coil, in which the internal helical coil is maintained in a predetermined position by an internal baffle having radially extending fingers defining a double helix.

BACKGROUND OF INVENTION

A typical automotive air conditioning system includes a compressor, a condenser, an expansion device, and an evaporator. Hydraulically connecting the aforementioned components in series are refrigerant tubes that are capable of conveying high and low pressure refrigerant flows. A two phase refrigerant used in a modern automotive air conditioning system is an environmentally friendly refrigerant known as R-134a and low Global Warming Potential (GWP) refrigerants such as HFO-1234yf.

The compressor is commonly referred to as the heart of the air conditioning system in which it is responsible for compressing and transferring the refrigerant throughout the system. The compressor includes a suction side and a discharge side. The suction side is referred to as the low pressure side and the discharge side is referred to as the high pressure side.

The evaporator is disposed in the passenger cabin of the automobile and the condenser is disposed in the front portion of the engine compartment or more precisely, in front of the radiator. Within the evaporator, cold low pressure liquid refrigerant boils by absorbing heat from the passenger compartment. The low pressure vapor refrigerant exiting from the evaporator is drawn and compressed by the compressor into a high temperature vapor refrigerant. The compressed high temperature vapor refrigerant is then discharged by the compressor to the condenser. As the high pressure vapor refrigerant passes through the condenser, the refrigerant is condensed to a high pressure lower temperature liquid refrigerant as it releases the heat it absorbed from the passenger cabin to the ambient air outside of the passenger cabin. Exiting the condenser, the high pressure liquid refrigerant passes through an expansion device that regulates the flow of the high pressure liquid refrigerant to the evaporator to repeat the process of heat transfer from the cabin to the outside ambient air.

The temperature of the returning low pressure vapor refrigerant to the compressor from the evaporator is typically 40° F. to 100° F. lower than the high pressure liquid refrigerant exiting the condenser. An internal heat exchanger, such as a double pipe counter-flow heat exchanger, is known to be used to take advantage of the temperature differential between the low pressure low temperature vapor refrigerant and the high pressure high temperature liquid refrigerant to improve the overall cooling capacity of the air conditioning system. The double pipe heat exchanger includes an outer pipe and an inner pipe coaxially located within the outer pipe. The diameter of the inner pipe is smaller than the diameter of the outer pipe, thereby defining an annular gap between the inner pipe and outer pipe for refrigerant flow. The relatively cooler low pressure vapor refrigerant exiting the evaporator is passed through the annular gap and the relatively hotter liquid refrigerant exiting the condenser is passed through the inner pipe. Heat is transferred from the high pressure liquid refrigerant exiting the condenser to the cooler low pressure vapor refrigerant returning to the compressor in the internal heat exchanger. By decreasing the temperature of the high pressure liquid refrigerant prior to its flowing through the expansion device, the expansion device may be set at a lower temperature; therefore the temperature of the refrigerant entering the evaporator is at a lower temperature. A SAE International Publication No. 2007-01-1523 has shown that an internal heat exchanger such as the one described above can increase the amount of internal heat exchange from 390 W to 550 W; thereby improving the cooling performance of the air conditioning system.

The internal heat exchanger describe above has its disadvantages. The installation of such a heat exchanger into an engine compartment is difficult due to the limited amount of space within an engine compartment. Furthermore, such a double pipe heat exchanger is also known for low heat transfer efficiency and high pressure drop. It is therefore desirable to have an internal heat exchanger that is compact, but with a high heat transfer effectiveness and low pressure drop. It is further desirable to have a compact internal heat exchanger that is robust during normal operating conditions. It is still further desirable to have a compact internal heat exchanger that is cost effective to manufacture.

SUMMARY OF THE INVENTION

The present invention relates to an internal heat exchanger assembly for an air conditioning system. The internal heat exchanger includes a housing having a first end, a second end axially opposed to the first end, and an interior surface therebetween defining a substantially cylindrical cavity. A helical coiled tube is disposed about the axis within the cylindrical cavity. The helical coiled tube includes first and second tube ends extending in opposing directions substantially parallel to the axis beyond the first and second ends of the housing. The helical coiled tube further includes a plurality of adjacent coils having a predetermined coil pitch.

Coaxially disposed within the substantially cylindrical cavity is an elongated twisted strip extending from the first end to the second end. The elongated strip includes opposed edges defining, when twisted from its initial flat state, a double helix. A plurality of spaced fingers extends radially from the edges. The fingers are sized to fit closely between the coils, thereby inhibiting lateral movement of coils.

Sealing the ends of the substantially cylindrical cavity is a first end cap and a second end cap. Each end cap includes a first port in hydraulic communication with the cylindrical cavity and a tube coupling adapted to support a tube end.

The helical coiled tube includes a basic tube outer diameter ($D_{tube}$) and a helical coil outer diameter ($D_{coil}$). Helical coil outer diameter ($D_{coil}$) is sized to fit substantially within the diameter of the substantially cylindrical cavity ($D_{cavity}$) with an annular gap between the outer coil diameter ($D_{coil}$) and cavity diameter ($D_{cavity}$). The annular gap is sized to provide a substantially unobstructed pathway for refrigerant flow through the cylindrical cavity; thereby, improving the overall heat transfer in several ways and decreasing the pressure drop significantly. The extending fingers of the elongated twisted strip maintain the annular gap of the helical coiled tube within the cylindrical cavity.

The invention provides an internal heat exchanger that is compact, with a high heat transfer effectiveness and low pressure drop. The invention further provides a compact internal heat exchanger that is robust during normal operating conditions and cost effective to manufacture. The decrease in pressure drop of the refrigerant in the internal heat exchanger increases cooling capacity of the overall air conditioning system.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
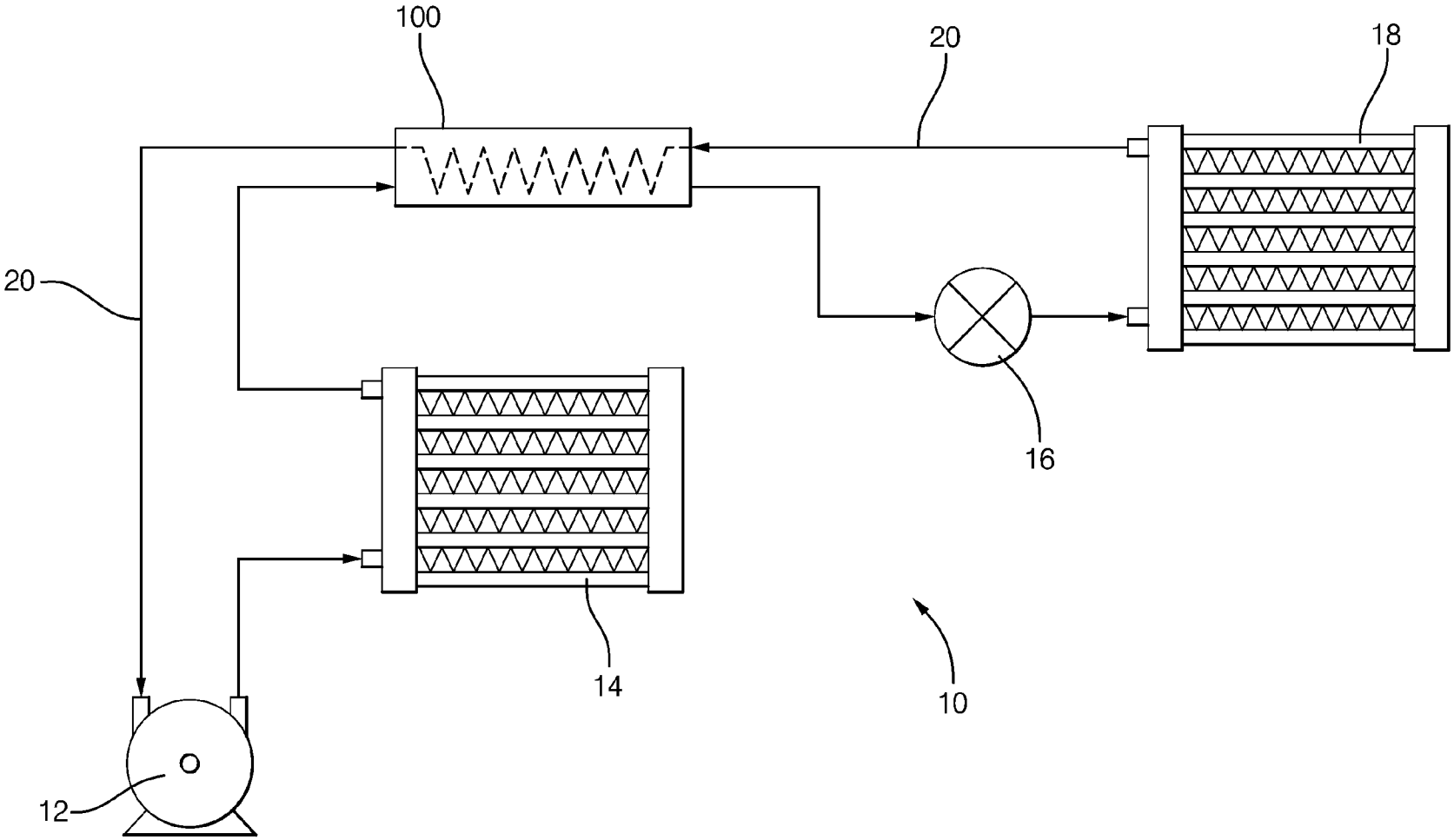
FIG. 1 is an automotive air conditioning system having an internal heat exchanger assembly that uses the lower temperature refrigerant exiting the evaporator to cool the higher temperature refrigerant exiting the condenser prior to an expansion device.

In accordance with a preferred embodiment of this invention, referring to FIGS. 1-4, is air conditioning system 10 having compressor 12, condenser 14, expansion device 16, evaporator 18, and refrigerant tubes 20 hydraulically connecting the aforementioned components in series. Air conditioning system 10 further includes internal heat exchanger 100 to increase the heat transfer capacity of air conditioning system 10.

Shown in FIG. 1, low pressure vapor refrigerant exiting from evaporator 18 is drawn and compressed by compressor 12 into a high pressure vapor refrigerant, which is then discharged to condenser 14. Within condenser 14, the high pressure vapor refrigerant is condensed to a high pressure liquid refrigerant. The high pressure liquid refrigerant then passes through expansion device 16 that regulates the flow of the refrigerant to evaporator 18, in which the high pressure liquid refrigerant expands into the low pressure vapor refrigerant as it absorbs heat from the cabin of an automobile.

Internal heat exchanger assembly 100 is disposed in the air conditioning system 10 between discharge side of evaporator 18 and discharge side of condenser 14 prior to expansion device 16. The flow of low pressure vapor refrigerant from evaporator 18 is counter-current to the flow of high pressure liquid refrigerant from condenser 14 through internal heat exchanger assembly 100. An alternative embodiment (not shown) is that the flow of low pressure vapor refrigerant is co-current with the flow of high pressure vapor refrigerant. The relatively lower temperature low pressure vapor refrigerant exiting the evaporator 18 is used to precool the relatively higher temperature high pressure liquid refrigerant exiting the condenser 14 prior to expansion device 16. The temperature of the returning low pressure vapor refrigerant to compressor 14 from evaporator 18 is typically 40° F. to 100° F. lower than the high pressure liquid refrigerant exiting condenser 14.

Figure 2:
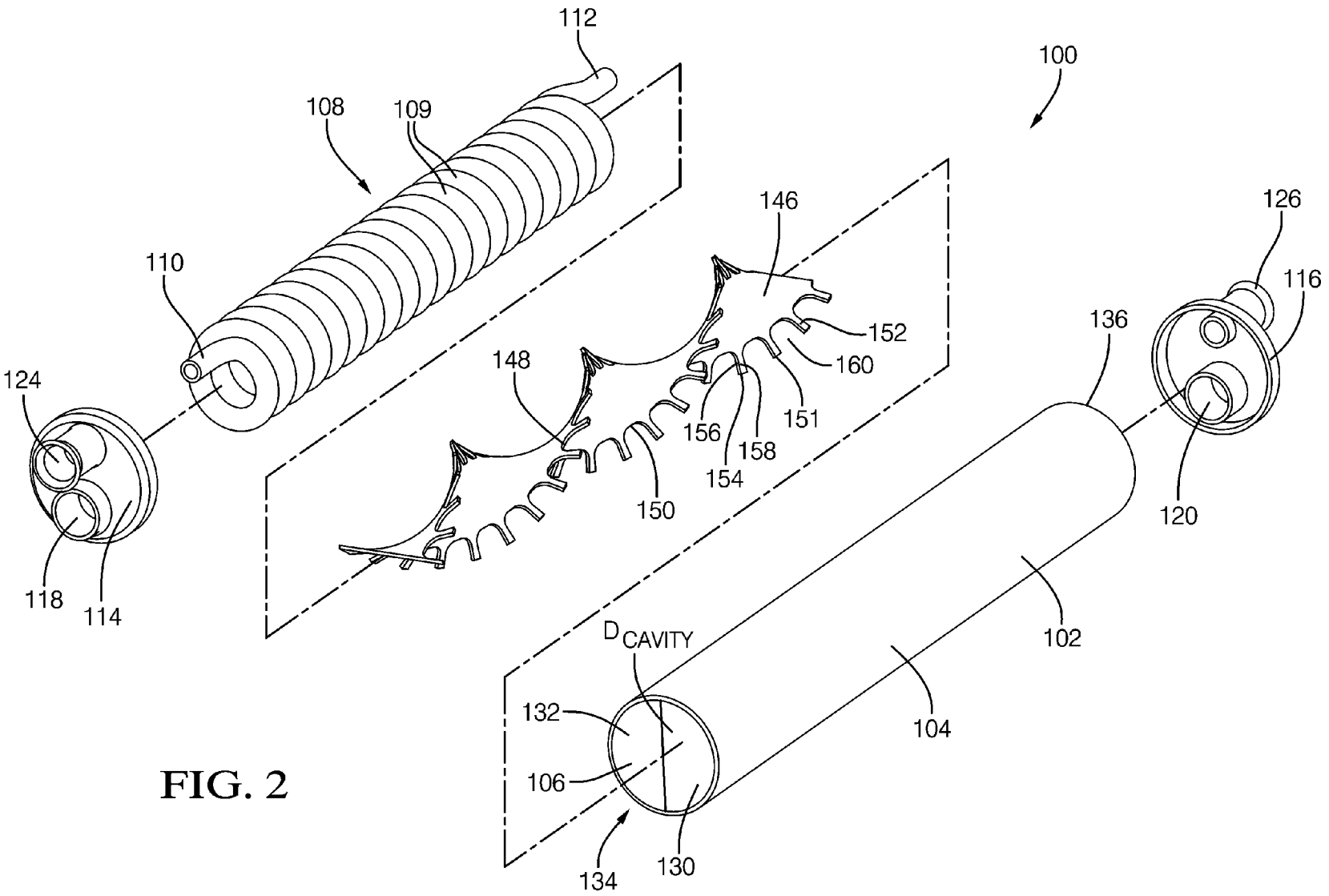
FIG. 2 is an exploded view of the heat exchanger assembly showing the housing, helical coiled tube, twisted elongated baffle having a plurality of fingers, and end caps to seal either end of the housing.

Shown in FIG. 2 is an exploded view of internal heat exchanger assembly 100 includes housing 102 having a substantially cylindrical cavity 130, an internal helical coiled tube 108 within cylindrical cavity 130, and a coaxially disposed elongated baffle 146 having radially extending fingers 152. Fingers 152 are adapted to be inserted between and engage with adjacent coils 109 to maintain helical coiled tube 108 in a predetermined position and provide structural integrality to internal heat exchanger assembly 100. Hydraulically sealing housing 102 are end caps 114, 116. Each of end caps 114, 116 includes a port 118, 120 and a tube coupling 124, 126.

Housing 102 includes exterior surface 104, first end 134 and axially opposed second end 136 and central axis A. Interior surface 106 defines a substantially cylindrical cavity 130 disposed about Axis A. Best shown in FIG. 4, cylindrical cavity 130 includes a substantially circular cross sectional area having a cavity diameter ($D_{Cavity}$). Referring back to FIG. 2, exterior surface 104 of the housing 102 also has a substantially cylindrical shape; however, the shape of exterior surface 104 of housing 102 may be that of any shape provided that it is capable of accommodating cylindrical cavity 130 defined by interior surface 106.

Figure 3:
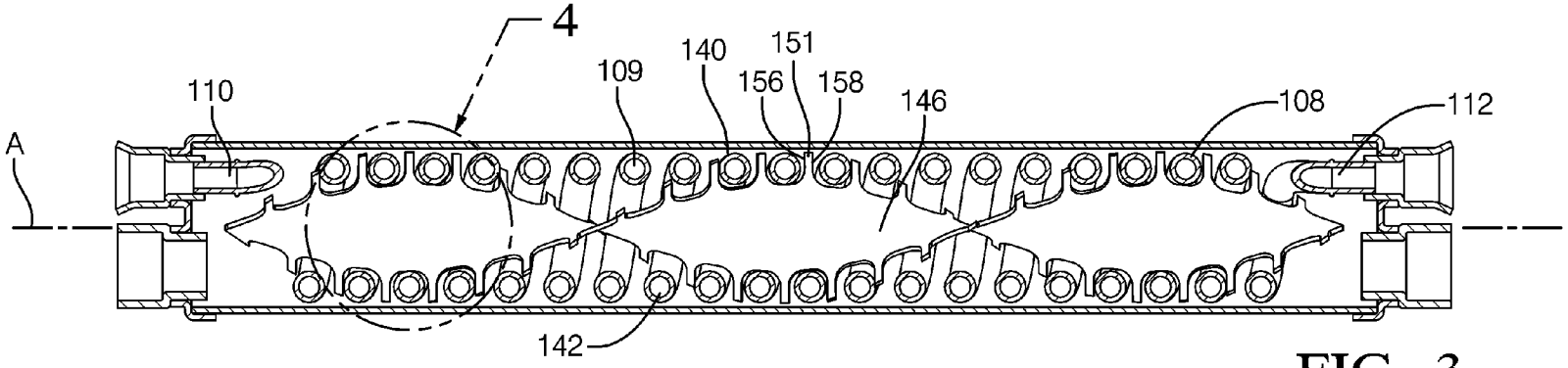
FIG. 3 is a longitudinal cross sectional view of the heat exchanger assembly showing an elongated twisted baffle having a plurality of fingers maintaining the helical coiled tube in a predetermined position.

Referring to FIG. 3, co-axially disposed within housing 102 is a single tube spiraled about axis A to provide helical coiled tube 108. Helical coiled tube 108 includes a first tube end 110 that extends beyond first end 134 and substantially parallel to Axis A. Helical coiled tube 108 also includes a second tube end 112 extending in a direction opposite that of first tube end 110 and beyond the second end 136 of housing 102.

Referring back to FIG. 4, helical coiled tube 108 includes basic tube diameter ($D_{tube}$) and outer helical coil diameter ($D_{coil}$). The basic tube diameter ($D_{tube}$) is the diameter of the tube that forms helical coiled tube 108. Outer helical coil diameter ($D_{coil}$) is measured across the coils 109, normal to axis A. Outer helical oil diameter ($D_{coil}$) is sized to fit within cavity diameter ($D_{cavity}$) to define annular gap 144 between outer helical coil diameter ($D_{coil}$) and cavity Diameter ($D_{cavity}$). The axial distance between adjacent coils 109 is coil pitch ($Coil_{pitch}$).

Referring back to FIG. 2, disposed within housing 102 and sized to fit between first end 134 and second end 136 is a coaxially located elongated baffle 146. Elongated baffle 146 has a substantially rectangular profile that is continuously twisted co-axially along Axis A. Elongated baffle 146 includes a first baffle edge 148 and an opposed second baffle edge 150. The substantially rectangular profile shown is for exemplary purpose only. The profile may be that of any shape provided it includes at least two opposing baffle edges 148, 150.

Each baffle edge 148, 150 includes a plurality of fingers 152 extending perpendicularly from its respective baffle edge 148, 150 and radially away from Axis A, taking on the same double helix as the twisted edges 148 and 150. Each finger 152 includes a distal end 151 and a center portion 154 bounded by a first side 156 and an opposite second side 158. First side 156 of finger 152 faces the second side 158 of its immediate adjacent finger 152 to define slot 160 therebetween. The length of each finger 152 is sufficient for distal end 151 to abut interior surface 106 of housing 102 to co-axially align and support twisted elongated baffle 146 along Axis A. Each slot 160 is adapted to accept a portion of a coil 109, in which the sides 156, 158 of adjacent fingers cooperate with a portion of edge 148, 150 located between fingers 152 to secure helical coiled tube 108 in a predetermined position within cylindrical cavity 130 and maintain annular gap distance ($GAP_{distance}$) between distal ends 140, 142 of coils 109 and interior surface 106 of the housing. Radially extending fingers 152 allow internal heat exchanger 100 to be bent into an arch or semi-circular shape (not shown) for packaging requirements without damaging or dislocating helical coiled tube 108 from its predetermined position.

Elongated ribs (not shown) may be formed onto a portion of the interior surface 106 of internal heat exchanger assembly 100. The elongated ribs may extend substantially parallel to the A-axis or spiraled about the A-axis. Each rib includes a distal surface spaced apart from interior surface 106, in which the distal surface abuts helical coiled tube 108. The elongated ribs assist in securing helical coiled tube 108 in the predetermined position to maintain the desired annular gap distance ($GAP_{distance}$).

Sealing first and second ends of cylindrical cavity 130 are first and second end caps 114, 116, respectively. Each of first and second end caps 114, 116 includes a port 118, 120 in hydraulic communication with cylindrical cavity 130, and a tube coupling 124, 126. Each of tube coupling 124, 126 is adapted to support respective tube ends 110, 112 of helical coiled tube 108. An alternative embodiment, not shown, is that one of end caps 114, 116 is formed integrally with corresponding tube end 110, 112.

The relatively cooler low pressure gas refrigerant from evaporator 18 is introduced into cylindrical cavity 130 through one of ports 118, 120. The relatively hotter high pressure liquid refrigerant discharge from condenser 14 is introduced into helical coiled tube 108 via one of tube ends 110, 112. Heat is transferred from the high pressure liquid refrigerant in helical coiled tube 108 to the low pressure vapor refrigerant in cylindrical cavity 130 via conduction by counter-current or con-current refrigerant flow.

Figure 4:
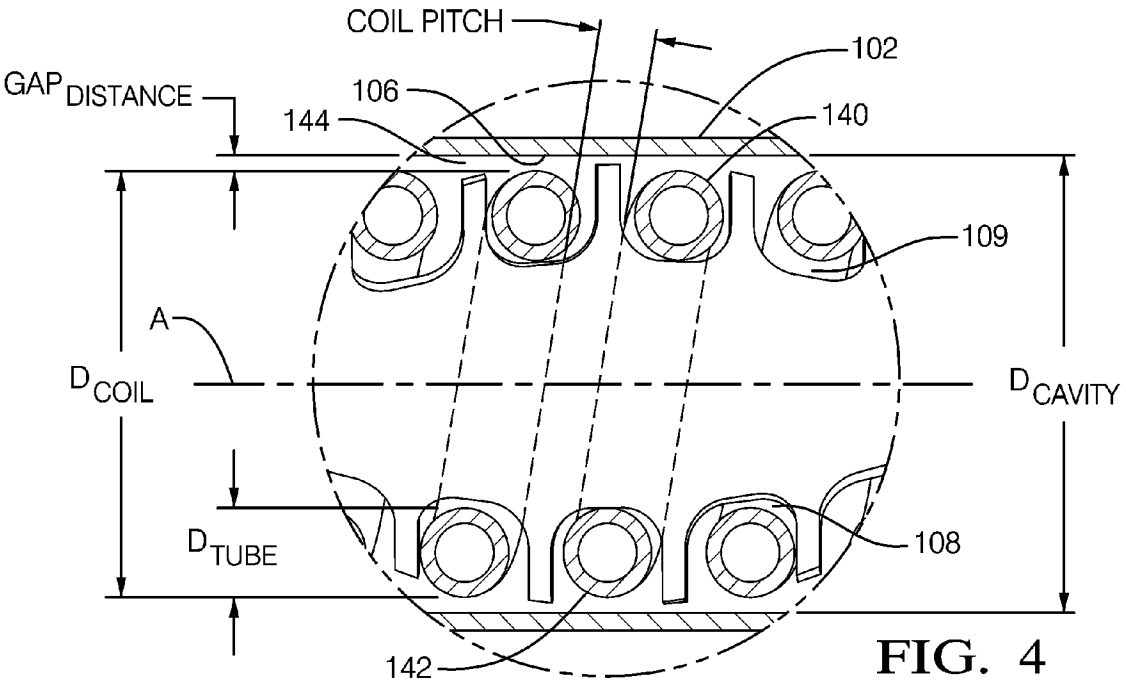
FIG. 4 is an enlarged view of section 4 of FIG. 3, showing the extending fingers of the elongated twisted baffle engaged to the helical coiled tube and interior surface of the housing.

Best shown in FIG. 4, annular gap 144 provides a substantially unobstructed pathway for low pressure vapor refrigerant flow through cylindrical cavity 130; thereby, improving the overall heat transfer in several ways and decreasing the pressure drop significantly. Firstly, annular gap 144 allows refrigerant to fully access the outer surfaces of the coils 109, thereby increasing the total heat transfer area between helical coiled tube 108 and refrigerant. Secondly, annular gap 144 allows lubricating oil entrained in the refrigerant to move along interior surface 106 unobstructed; thereby minimizing oil sludge buildup, which would create a barrier or insulator to heat transfer. Annular gap 144 also reduces the pressure drop significantly allowing the refrigerant to flow more easily around helical coil diameter 138. As discussed below, reduced pressure drop within internal heat exchanger 100 results in the increased overall cooling capacity of air conditioning system 10.

Internal heat exchanger assembly 100 may be manufactured by any method known to those skilled in the art. Housing 102 and one of end caps 114, 116 may be molded or fabricated as one integral unit. The other remaining end cap 114, 116 may be manufactured as a separate piece. Helical coil tube 108 may be attached to elongated baffle 146 by continually twisting successive adjacent coils 109 onto radially extending fingers 152 of elongated baffle 146 until helical coil tube 108 is completely assembled onto elongated baffle 146. The assembly of elongated baffle 146 and helical coil tube 108 is then joined by brazing or other known means before the assembly is inserted into cylindrical cavity 130. Once the assembly is inserted and properly located within the cylindrical cavity 130, the other remaining end cap 114, 116 is fitted onto the respective end 134, 136 to seal cylindrical cavity 130. If the components of internal heat exchanger assembly 100 are amenable to brazing, the individual components may be assembled as a whole and brazed to from one integrated unit.

Those skilled in the art would recognize that the rate of heat transfer effectiveness of heat from a fluid within a tube to the ambient fluid outside of the tube is directly proportional to the velocity of the ambient fluid flow over the surface of the tube; the greater the velocity, the greater the heat transfer effectiveness. An example would be a fan inducing an air stream over the tubes of a radiator of an automobile to increase the heat transfer effectiveness of the radiator. Internal heat exchanger assembly 100 described herein above provides increased heat transfer effectiveness with decreased velocity of refrigerant over the surface area of the helical coil. Decreased refrigerant velocity results in the decrease of pressure drop through internal heat exchanger 100, thereby increasing the cooling capacity of the overall air conditioning system, which will be discussed in detail below.

FIGS. 5(A-D) present the heat transfer effectiveness of internal heat exchanger 100 relative to cavity diameter ($D_{cavity}$), tube outer diameter ($D_{tube}$), annular gap distance ($GAP_{distance}$), and coil pitch ($Coil_{pitch}$) dimensions, respectively. The dimensions of each parameter are presented on the x-axis and the heat transfer effectiveness is presented on the left y-axis. FIGS. 5(A-D) also show the relationship in refrigerant velocity (ft/min) through the internal heat exchange on the right y-axis relative to the parameters on the x-axis.

Figure 5A:
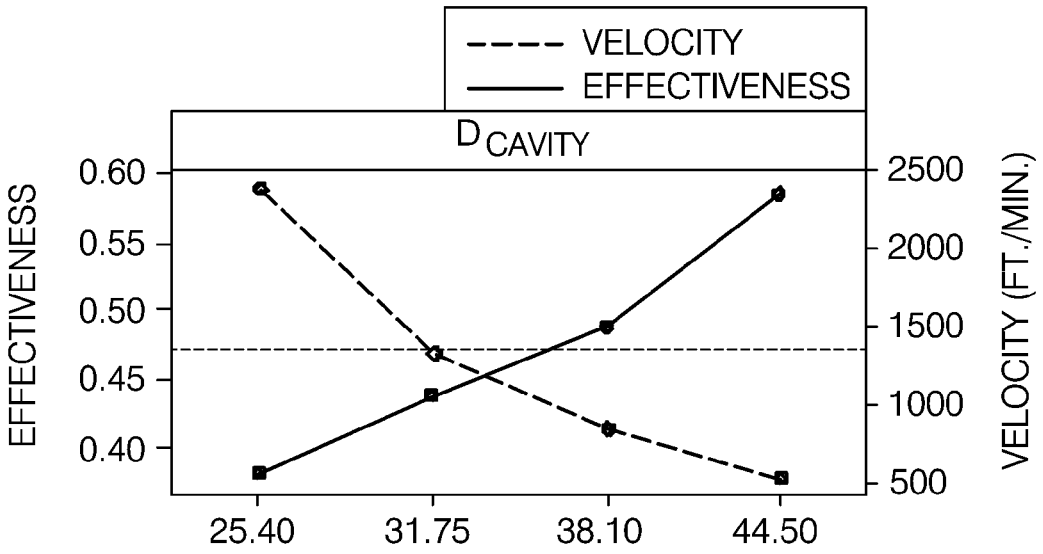
FIGS. 5 (A-D) present the relationship of the heat transfer effectiveness of the internal heat exchanger relative to the cavity diameter ($D_{cavity}$), basic tube diameter ($D_{tube}$), annular gap distance ($GAP_{distance}$), and coil pitch ($Coil_{pitch}$), respectively; as well as changes in velocity of the refrigerant relative to aforementioned dimensions.
Figure 6:
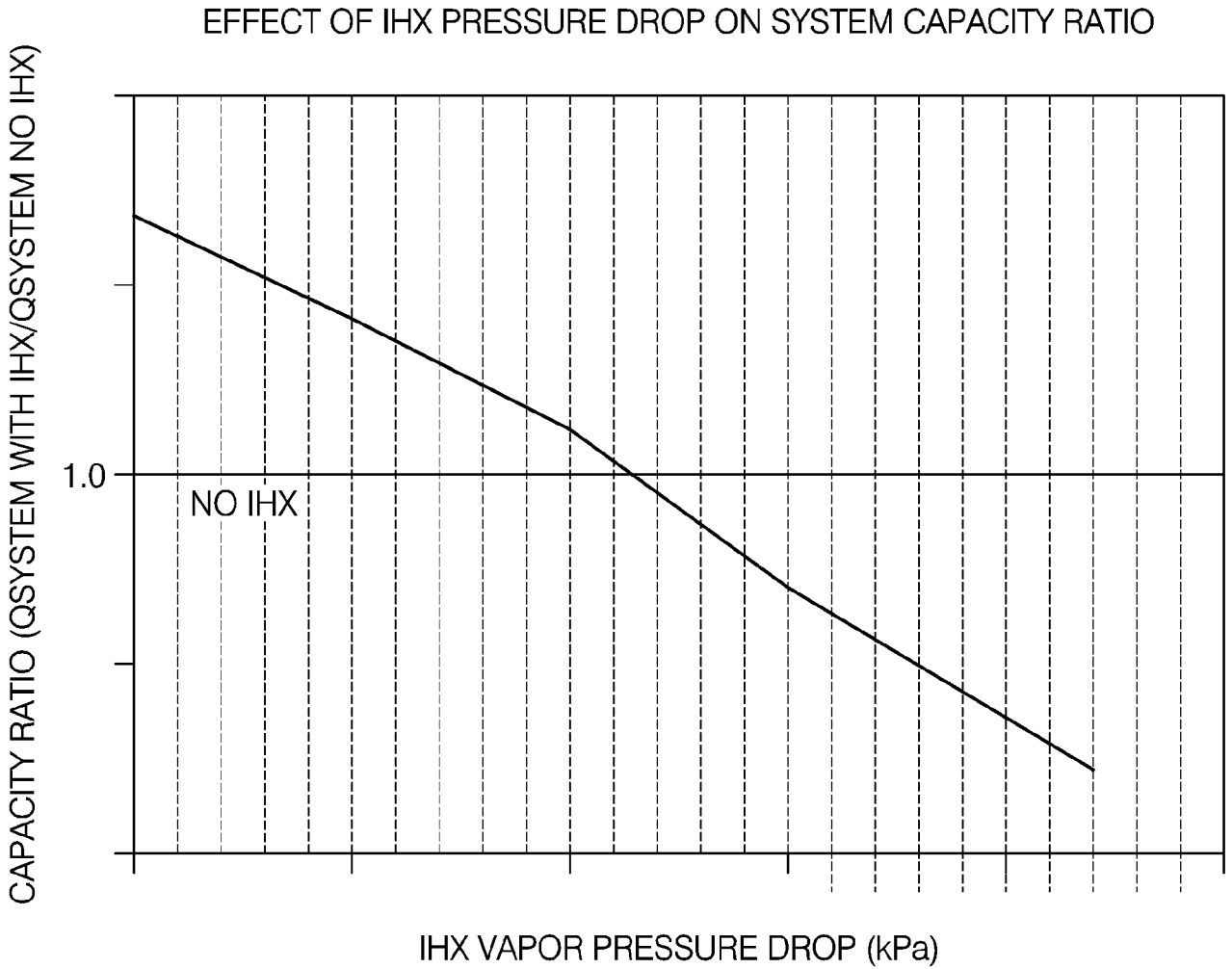
FIG. 6 presents the relationship of the heat transfer capacity of an automotive air conditioner having an internal heat exchanger assembly relative to the pressure drop of the vapor refrigerant within the internal heat exchanger assembly.

Presented in FIG. 5(A), the heat transfer effectiveness increases as the cavity diameter ($D_{cavity}$) is increased. FIG. 5(A) also indicates that an increase in cavity diameter ($D_{cavity}$) results in a decrease of refrigerant flow velocity. In other words, an increase in cavity diameter ($D_{cavity}$) provides the benefit of improved heat transfer effectiveness of internal heat exchanger 100 and a decrease in refrigerant flow velocity. In turn, the decrease in refrigerant flow velocity results in a decrease in pressure drop across internal heat exchanger assembly 100. The decrease in pressure drop across internal heat exchanger 100 results in increased cooling capacity of the automotive air conditioning system, which is shown in FIG. 6 and discussed in detail below. The increase in cavity diameter ($D_{cavity}$) is limited to the packaging requirement of internal heat exchanger assembly 100 under the hood of the automobile. Therefore, tube outer diameter ($D_{tube}$), the annular gap distance ($GAP_{distance}$), and coil pitch ($Coil_{pitch}$) dimensions are selected to cooperate with the selected dimension of cavity diameter ($D_{cavity}$) to maximize transfer effectiveness and minimize refrigerant pressure drop.

Figure 5B:
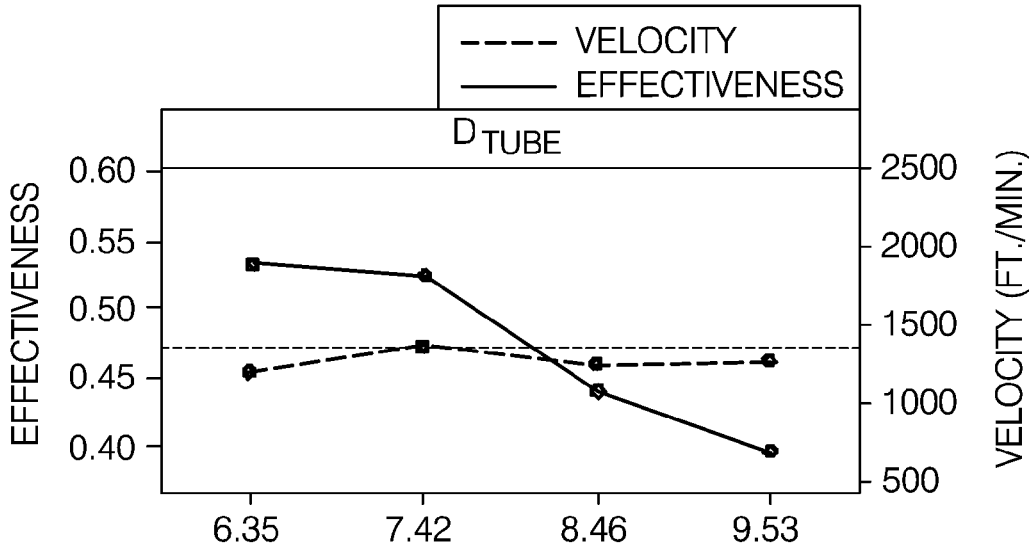
Figure 5C:
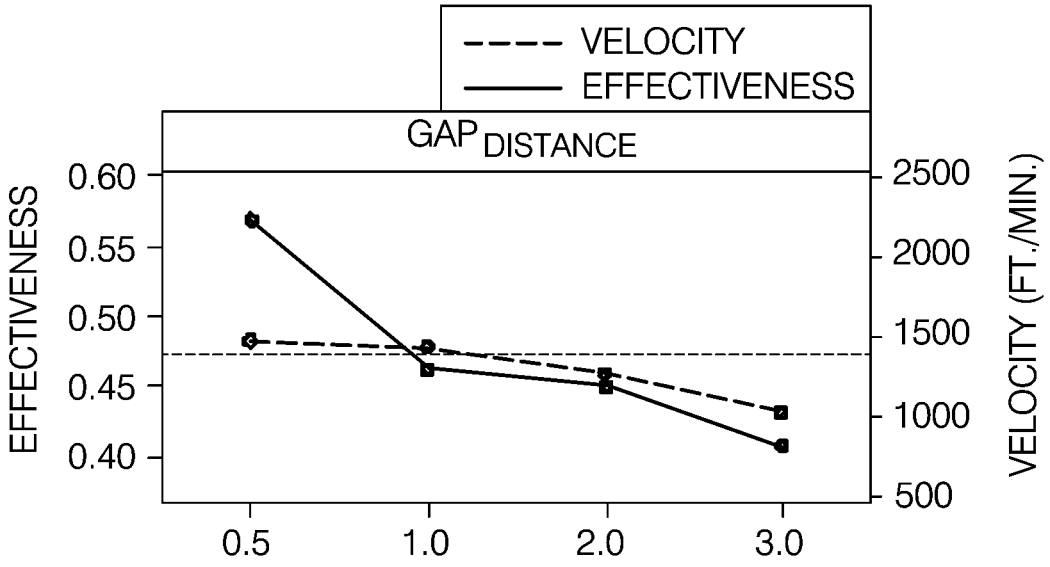
Figure 5D:
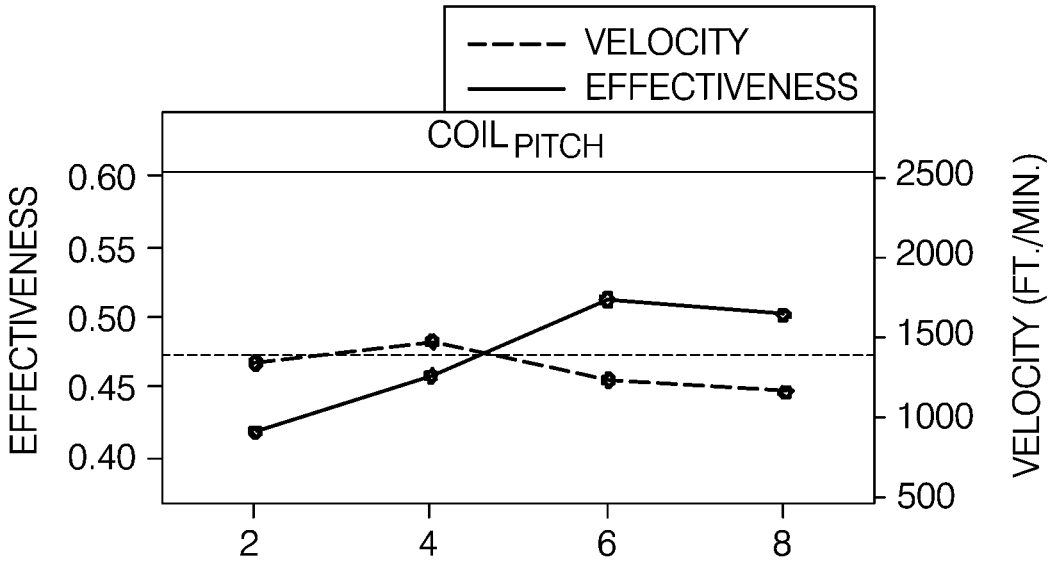

As shown in FIGS. 5(B)-(D), the change in tube outer diameter ($D_{tube}$), the annular gap distance ($GAP_{distance}$), and coil pitch ($Coil_{pitch}$) also affect heat transfer effectiveness, but have minimal effect on refrigerant velocity. For improved heat transfer effectiveness and decreased pressure drop across internal heat exchanger 100 for an automotive air conditioning system, the cavity Diameter ($D_{cavity}$) ranges between 25 to 45 mm, preferably 32 mm to 38 mm; the basic tube diameter ($D_{tube}$) ranges between 6 mm to 10 mm, preferably 7 mm to 9 mm; the coil pitch ($Coil_{pitch}$) ranges between 2 mm to 8 mm, preferably 4 mm to 6 mm; and the annular gap distance ($GAP_{distance}$) ranges between 0.5 to 3 mm, preferably 1 mm to 2 mm.

FIG. 6 presents a graph showing the heat transfer capacity increase of an automotive heat exchanger system having an internal heat exchanger assembly. The y-axis shows the heat transfer capacity ratio of an air conditioning system with an internal heat exchanger as compared to an air conditioning system without an internal heat exchanger. The scale of 1.0 represents a system without an internal heat exchanger assembly, which is shown as a solid horizontal line for reference. The greater the heat transfer capacity ratio, the greater the heat transfer capacity of the air conditioning system. The x-axis represents the vapor pressure drop of the vapor refrigerant flow within the internal heat exchanger.

As shown in FIG. 6, the heat transfer capacity ratio of an air conditioning system with an internal heat exchanger is inversely proportional to the pressure drop of the vapor refrigerant flow within the internal heat exchanger. The lower the pressure drop across internal heat exchanger 100, the higher the heat transfer capacity ratio of the overall air conditioning system. The amount of pressure drop directly correlates with the refrigerant flow velocity through cylindrical cavity 130; therefore, the lower the refrigerant flow velocity, the higher the heat transfer capacity of the air conditioning system.

An advantage of the internal heat exchanger disclosed herein is that it provides maximum heat transfer effectiveness within the internal heat exchanger and increased heat transfer capacity of the air conditioning system. Another advantage is that internal twisted baffle's radially extending fingers maintain the lateral and radial positions of the internal helical coiled tube within the housing, thereby ensuring maximum performance and minimizing vibrations during normal operating conditions. Still another advantage is that the contact of the distal ends of the radial fingers with the inner surface of the cylindrical inner surface increases the structural rigidity of the internal heat exchanger. Yet another advantage is that the internal heat exchanger is manufactured of standard materials that are easily assembled and brazed, or interference fitted together. Another advantage is that the internal twisted baffle's radially extending fingers allow the internal heat exchanger 100 to be bent into an arch shape without damaging or dislocating the helical coiled tube from its predetermined position.

While this invention has been described in terms of the preferred embodiments thereof, it is not intended to be so limited, but rather only to the extent set forth in the claims that follow.

Having described the invention herein, it is claimed:

1. An internal heat exchanger assembly for an air conditioning system, comprising: a housing having a first end, a second end axially opposed to said first end, and an interior surface therebetween defining a substantially cylindrical cavity having a cylindrical cavity diameter about an axis; a tube helically disposed about said axis within said cylindrical cavity to define a helical coil outer diameter, wherein said tube includes first and second tube ends extending in opposing directions substantially parallel to said axis beyond said first and second ends of said housing; a first end cap adapted to seal said first end of said housing, wherein said first end cap includes a first port in hydraulic communication with said cylindrical cavity and a first tube coupling adapted to support said first tube end; and a second end cap adapted to seal said second end of said housing, wherein said second end cap includes a second port in hydraulic communication with said cylindrical cavity and a second tube coupling adapted to support said second tube end; and an elongated strip having a central portion, said elongated strip coaxially disposed within said cylindrical cavity extending from said first end to said second end, wherein said elongated strip is twisted along said axis and said central portion continuously extends through said axis from said first tube end to said second tube end; wherein said helical coiled tube includes a plurality of adjacent coils having a predetermined pitch defining a gap between adjacent coils; wherein said elongated strip includes opposing longitudinal edges helically disposed about said axis and having a plurality of radially extending fingers distributed along the longitudinal edges and defining a double helix; and wherein each of said fingers includes two opposing sides substantially perpendicular to said axis abutting said adjacent coils, thereby inhibiting lateral movement of coils.

2. The heat exchanger assembly of claim 1, wherein each of said radially extending fingers includes a distal end abutting said interior surface of said housing.

3. The heat exchanger assembly of claim 2, wherein said elongated strip includes an edge portion substantially parallel to said axis between two adjacent extending fingers, wherein said edge portion abuts said coil, thereby inhibiting radial movement of coils toward said axis.

* * * * *